US010561573B2

(12) United States Patent
Stuart

(10) Patent No.: US 10,561,573 B2
(45) Date of Patent: Feb. 18, 2020

(54) INFANT BURPING ASSEMBLY

(71) Applicant: Kosi Stuart, Brooklyn, NY (US)

(72) Inventor: Kosi Stuart, Brooklyn, NY (US)

( * ) Notice: Subject to any disclaimer, the term of this patent is extended or adjusted under 35 U.S.C. 154(b) by 471 days.

(21) Appl. No.: 15/413,909

(22) Filed: Jan. 24, 2017

(65) Prior Publication Data

US 2018/0207057 A1 Jul. 26, 2018

(51) Int. Cl.
*A61H 23/00* (2006.01)

(52) U.S. Cl.
CPC ... *A61H 23/006* (2013.01); *A61H 2201/1207* (2013.01); *A61H 2201/165* (2013.01); *A61H 2201/1623* (2013.01); *A61H 2201/1652* (2013.01); *A61H 2201/1664* (2013.01)

(58) Field of Classification Search
CPC ..... A61H 2201/12; A61H 2201/1207; A61H 2201/1215; A61H 2201/123; A61H 2201/14; A61H 2201/1418; A61H 2201/16; A61H 2201/1623; A61H 2201/1664; A61H 2201/165; A61H 2201/1652; A61H 2201/50; A61H 2201/5007
See application file for complete search history.

(56) References Cited

U.S. PATENT DOCUMENTS 3,351,052 A * 11/1967 Hewson ..... A61H 31/006 601/106
3,552,388 A 1/1971 Zelenka
4,664,098 A * 5/1987 Woudenberg ..... A61H 9/0078 601/106
D299,863 S 2/1989 Noble et al.
4,915,095 A * 4/1990 Chun ..... A61H 31/007 601/43
5,277,194 A * 1/1994 Hosterman ..... A61B 5/1135 600/534
5,520,616 A 5/1996 Hofmeister
6,142,963 A 11/2000 Black et al.
6,174,295 B1 * 1/2001 Cantrell ..... A61H 31/00 601/41
6,196,990 B1 * 3/2001 Zicherman ..... A61H 23/0254 604/29
6,736,785 B1 * 5/2004 Van Brunt ..... A61H 31/00 601/44
7,736,325 B2 6/2010 Tung et al.
8,777,880 B2 * 7/2014 Davis ..... A61H 1/008 601/107
8,945,029 B1 2/2015 Saling et al.
2002/0095103 A1 7/2002 Blue
2003/0028134 A1 * 2/2003 Lev ..... A61H 7/001 601/110
2005/0090768 A1 * 4/2005 Brattesani ..... A61H 23/02 601/70

(Continued)

FOREIGN PATENT DOCUMENTS

WO WO2014193363 12/2014

*Primary Examiner* — Justine R Yu
*Assistant Examiner* — Matthew R Moon

(57) ABSTRACT

An infant burping assembly for burping an infant includes a harness that may be worn on an infant. A plunger unit is provided and the plunger unit is coupled to the harness. The plunger unit abuts the infant's back when the harness is worn. The plunger unit is actuated to move between an extended position and a retracted position. In this way the plunger unit repeatedly strikes the infant's back thereby facilitating the infant to be burped.

13 Claims, 4 Drawing Sheets

(56) References Cited

U.S. PATENT DOCUMENTS

| | | | | |
|---|---|---|---|---|
| 2008/0161734 | A1* | 7/2008 | Blockton | A43B 3/0005 601/70 |
| 2009/0318813 | A1* | 12/2009 | Thompson | A61B 17/225 600/459 |
| 2012/0046579 | A1* | 2/2012 | Radl | A61H 11/00 601/46 |
| 2012/0241487 | A1* | 9/2012 | Zack | A47D 13/025 224/576 |
| 2013/0150759 | A1* | 6/2013 | Nitta | A61H 31/005 601/41 |
| 2014/0107545 | A1* | 4/2014 | Pathrose | A61H 15/0092 601/128 |
| 2015/0038887 | A1* | 2/2015 | Piccirillo | A61H 7/004 601/112 |

* cited by examiner

INFANT BURPING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to burping devices and more particularly pertains to a new burping device for burping an infant.

BRIEF SUMMARY OF THE INVENTION

An embodiment of the disclosure meets the needs presented above by generally comprising a harness that may be worn on an infant. A plunger unit is provided and the plunger unit is coupled to the harness. The plunger unit abuts the infant's back when the harness is worn. The plunger unit is actuated to move between an extended position and a retracted position. In this way the plunger unit repeatedly strikes the infant's back thereby facilitating the infant to be burped.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
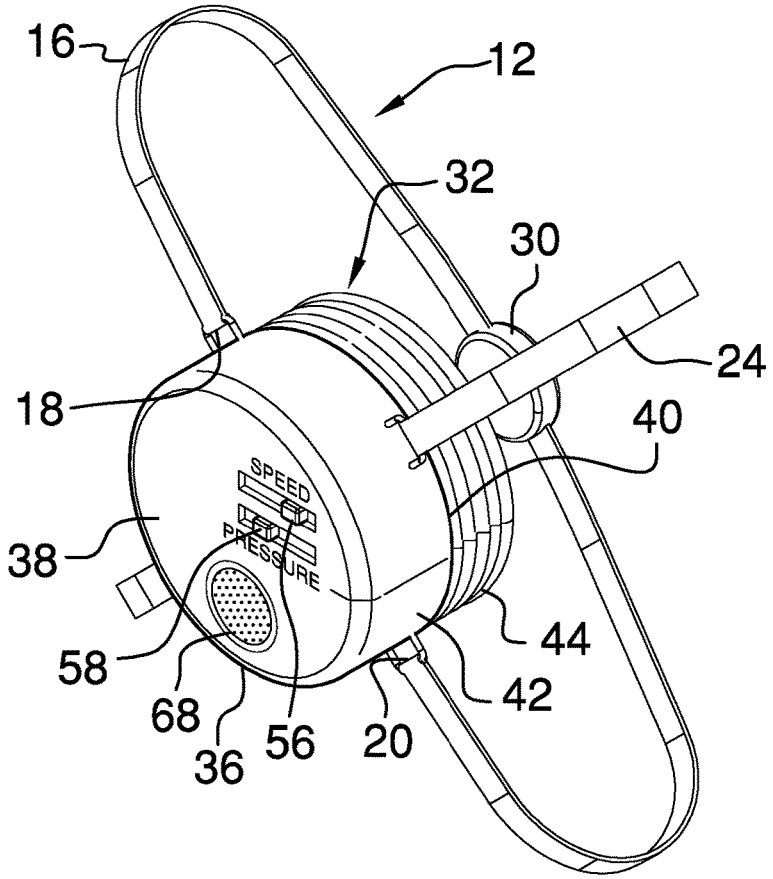
FIG. 1 is a back perspective view of an infant burping assembly according to an embodiment of the disclosure.
Figure 2:
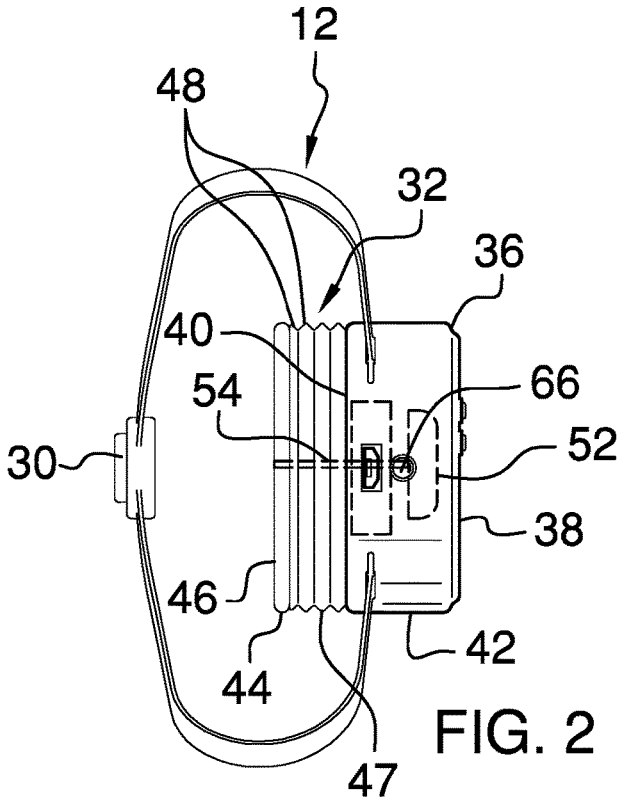
FIG. 2 is a left side view of an embodiment of the disclosure.
Figure 3:
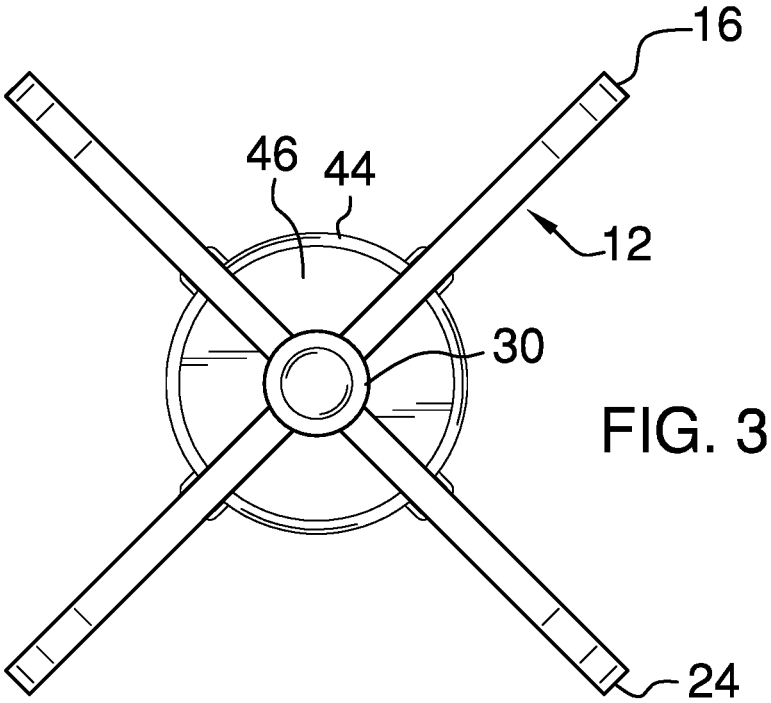
FIG. 3 is a front view of an embodiment of the disclosure.
Figure 4:
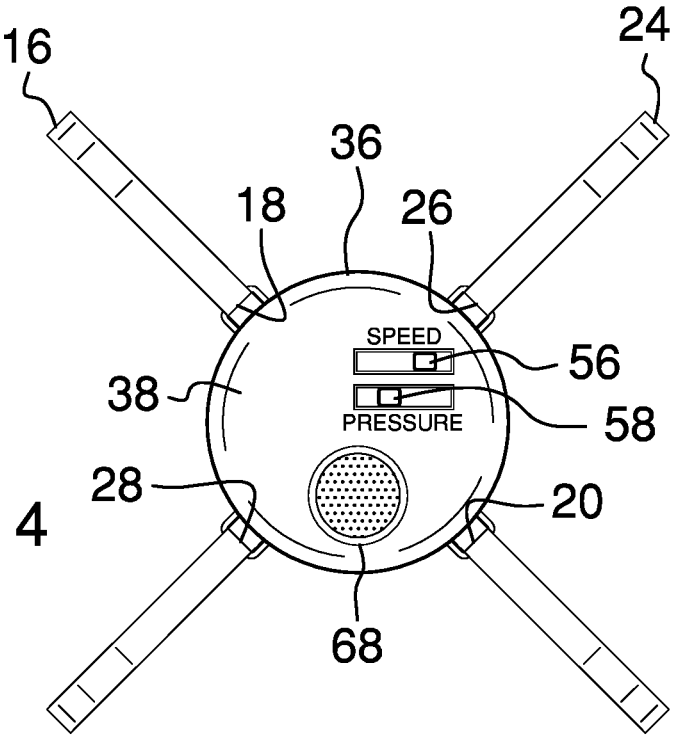
FIG. 4 is a back view of an embodiment of the disclosure.
Figure 5:
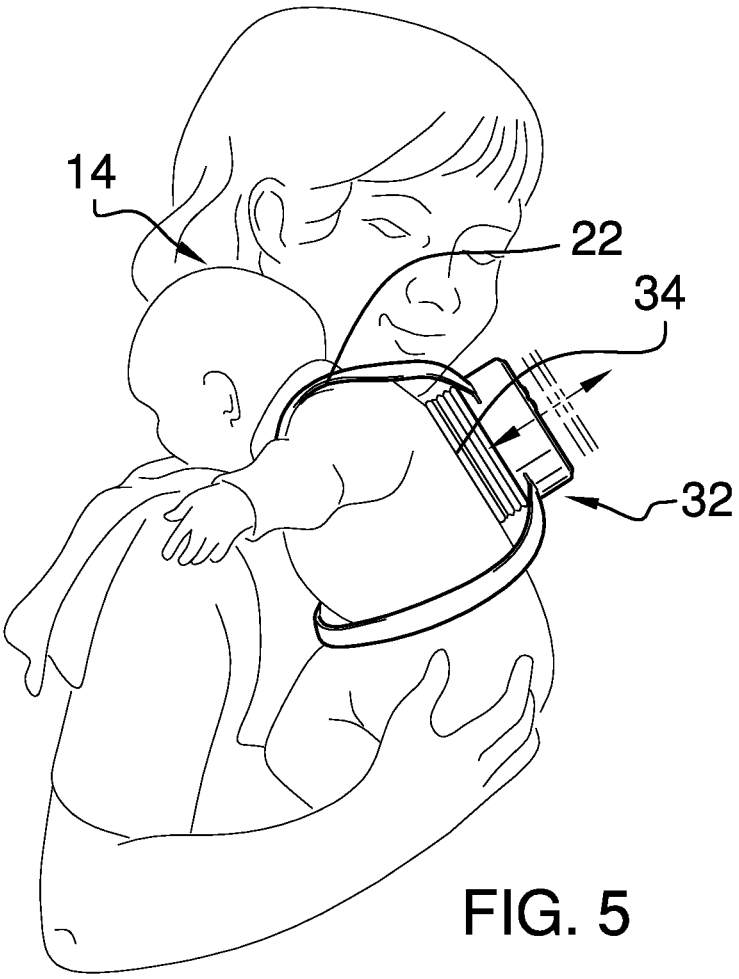
FIG. 5 is a perspective in-use view of an embodiment of the disclosure.
Figure 6:
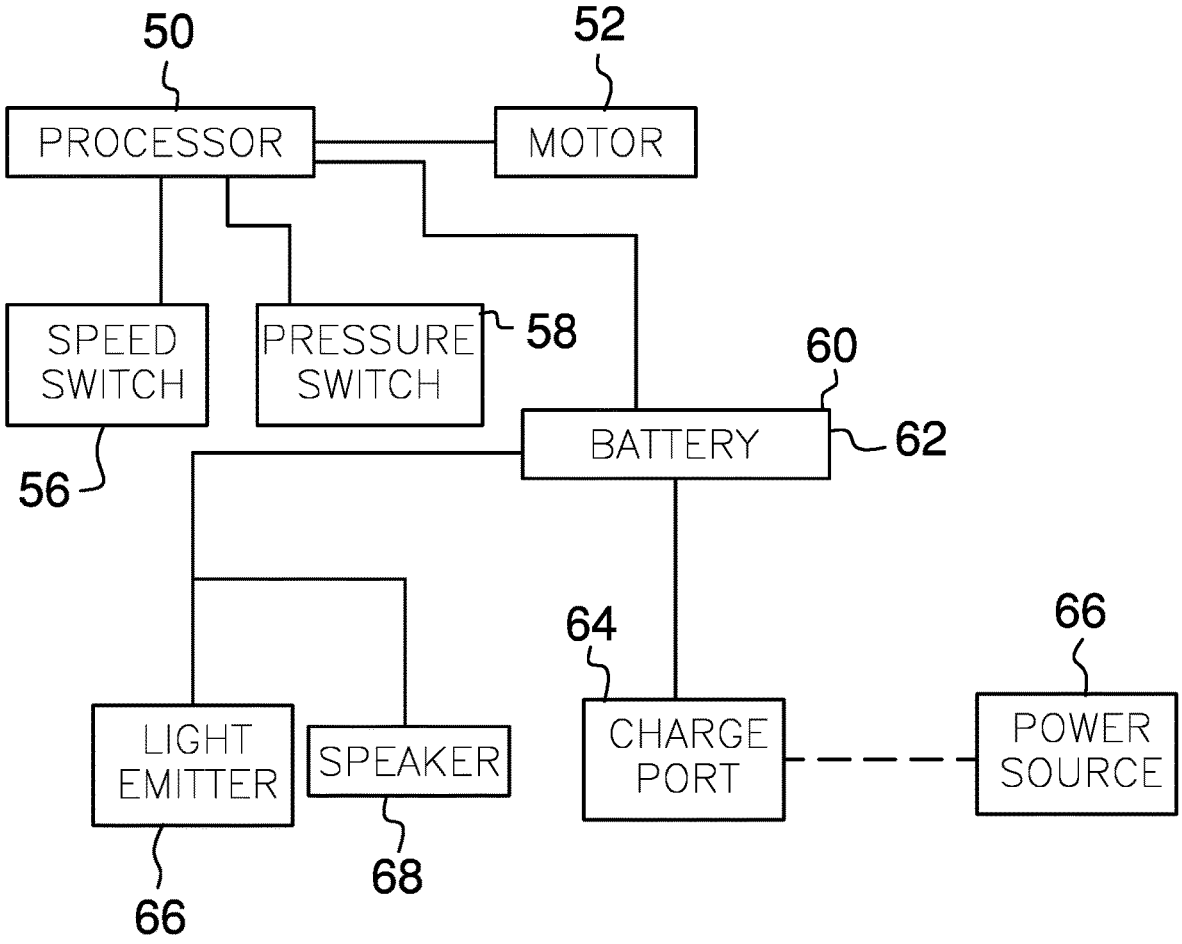
FIG. 6 is a schematic view of an embodiment of the disclosure.

With reference now to the drawings, and in particular to FIGS. 1 through 6 thereof, a new burping device embodying the principles and concepts of an embodiment of the disclosure and generally designated by the reference numeral 10 will be described.

As best illustrated in FIGS. 1 through 6, the infant burping assembly 10 generally comprises a harness 12 that may be worn on an infant 14. The harness 12 comprises a first strap 16 has a first end 18 and a second end 20. The first strap 16 is selectively extended over an associated one of the infant's shoulders 22. A second strap 24 is provided that has a first end 26 and a second end 28. The second strap 24 is selectively extended over an associated one of the infant's shoulders 22. Moreover, the second strap 24 intersects the first strap 16 at a central hub 30 such that each of the first strap 16 and the second strap 24 forms an X. The central hub 30 is positioned on the infant's chest 31 when the harness 12 is worn.

A plunger unit 32 is coupled to the harness 12 and the plunger unit 32 abuts the infant's back 34 when the harness 12 is worn. The plunger unit 32 is actuated to move between an extended position and a retracted position. In this way the plunger unit 32 repeatedly strikes the infant's back 34 thereby facilitating the infant 14 to be burped.

The plunger unit 32 comprises a housing 36 that has a first wall 38, a second wall 40 and an outer wall 42 extending therebetween. The outer wall 42 is continuous such that the housing 36 has a puck shape. Each of the first end 18 and the second end 20 of the first strap 16 is coupled to the outer wall 42. Additionally, each of the first end 26 and the second end 28 of the second strap 24 is coupled to the outer wall 42.

A bellows 44 is provided that has a primary wall 46 and an exterior wall 47 that is coupled to the second wall 40 of the housing 36. The primary wall 46 is spaced from the second wall 40 and the exterior wall 47 has a plurality of pleats 48. The pleats 48 are spaced apart from each other and are distributed between the second wall 40 of the housing 36 and the primary wall 46. The bellows 44 is selectively positioned between a collapsed position and an extended position with respect to the second wall 40. Additionally, the primary wall 46 abuts the infant's back 34 when the harness 12 is worn.

A processor 50 is positioned within the housing 36 and the processor 50 may comprise an electronic processor 50 or the like. A motor 52 is positioned within the housing 36 and the motor 52 may comprise an electric motor or the like. Moreover, the motor 52 is electrically coupled to the processor 50. A shaft 54 is coupled between the motor 52 and the primary wall 46 of the bellows 44. The motor 52 alternately urges the shaft 54 back and forth when the motor 52 is turned on. In this way the primary wall 46 of the bellows 44 repeatedly strikes the infant's back 34 thereby facilitating the infant 14 to be burped.

A speed switch 56 is slidably coupled to the first wall 38 of the housing 36 and the speed switch 56 is selectively manipulated. The speed switch 56 is electrically coupled to the processor 50 to actuate the motor 52 between a minimum speed and a maximum speed. A pressure switch 58 is slidably coupled to the first wall 38 of the housing 36 and the pressure switch 58 is selectively manipulated. The pressure switch 58 is electrically coupled to the processor 50 to actuate the motor 52 between a minimum intensity and a maximum intensity.

A power supply 60 is coupled to the housing 36 and the power supply 60 is electrically coupled to the processor 50. The power supply 60 comprises at least one battery 62 that is removably positioned within the housing 36. A charge port 64 is coupled to the outer wall 42 of the housing 36 and the charge port 64 is selectively electrically coupled to a power source 66. The power source 66 may be a battery charger, a charge cable or any other power source. The charge port 64 is electrically coupled to the at least one battery 62 such that the charge port 64 selectively charges the at least one battery 62. Moreover, the charge port 64 may be a USB port or the like.

A light emitter 66 is coupled to the outer wall 42 of the housing 36 to emit light outwardly therefrom. The light emitter 66 is electrically coupled to the at least one battery 62 and the light emitter 66 is turned on when the at least one battery 62 is fully charged. The light emitter 66 may be an LED or the like. A speaker 68 is coupled to the first wall 38 of the housing 36 to emit an audible sound. The speaker 68 is electrically coupled to the at least one battery 62 and the speaker 68 is turned on when the at least one battery 62 is fully charged.

In use, the harness 12 is positioned on the infant 14 having the bellows 44 abutting the infant's back 34 when the infant 14 is finished feeding or any other time when the infant 14 needs to be burped. The speed switch 56 is manipulated to turn the motor 52 on and to actuate the motor 52 at a selected speed between the minimum speed and the maximum speed. The motor 52 urges the primary wall 46 of the bellows 44 to move back and forth at the selected speed. In this way the bellows 44 repeatedly strikes the infant's back 34 thereby facilitating air in the infant 14's stomach to be released.

The pressure switch 58 is manipulated to select the intensity with which the bellows 44 strikes the infant's back 34. The plunger unit 32 facilitates the infant 14 to be burped without requiring a parent to manually burp the infant 14. In this way the parent avoids fatigue associated with burping the infant 14. The speed switch 56 is manipulated to turn the motor 52 off and the harness 12 is removed from the infant 14 when the infant 14 is burped.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An infant burping assembly being configured to burp an infant when the infant is done feeding, said assembly comprising:

a harness being configured to be worn on an infant, said harness comprising a first strap and a second strap, each of said first strap and said second strap having a first end and a second end;

a plunger unit being coupled to said harness wherein said plunger unit is configured to abut the infant's back, said plunger unit being actuated to move between an extended position and a retracted position wherein said plunger unit is configured to repeatedly strike the infant's back thereby facilitating the infant to be burped, said plunger unit comprising a housing having a first wall, a second wall and an outer wall extending therebetween, said outer wall being continuous such that said housing has a puck shape, each of said first end and said second end of said first strap being coupled to said outer wall, each of said first end and said second end of said second strap being coupled to said outer wall; and a bellows having a primary wall and an exterior wall being coupled to said second wall of said housing having said primary wall being spaced from said second wall, said exterior wall having a plurality of pleats, said pleats being spaced apart from each other and being distributed between said second wall of said housing and said primary wall, said bellows being selectively positioned between a collapsed position and an extended position with respect to said second wall, said primary wall being configured to abut the infant's back when said harness is worn.

2. The assembly according to claim 1, wherein said harness comprises a first strap having a first end and a second end, said first strap being configured to extend over an associated one of the infant's shoulders.

3. The assembly according to claim 2, further comprising a second strap having a first end and a second end, said second strap being configured to extend over an associated one of the infant's shoulders, said second strap intersecting said first strap at a central hub such that each of said first strap and said second strap forms an X-shape.

4. The assembly according to claim 1, further comprising:

a processor being positioned within said housing; and a motor being positioned within said housing, said motor being electrically coupled to said processor.

5. An infant burping assembly being configured to burp an infant when the infant is done feeding, said assembly comprising:

a harness being configured to be worn on an infant, said harness comprising a first strap and a second strap, each of said first strap and said second strap having a first end and a second end;

a plunger unit being coupled to said harness wherein said plunger unit is configured to abut the infant's back, said plunger unit being actuated to move between an extended position and a retracted position wherein said plunger unit is configured to repeatedly strike the infant's back thereby facilitating the infant to be burped, said plunger unit comprising a housing having a first wall, a second wall and an outer wall extending therebetween, said outer wall being continuous such that said housing has a puck shape, each of said first end and said second end of said first strap being coupled to said outer wall, each of said first end and said second end of said second strap being coupled to said outer wall;

a processor being positioned within said housing;

a motor being positioned within said housing, said motor being electrically coupled to said processor;

a bellows having a primary wall; and a shaft being coupled between said motor and said primary wall of said bellows, said motor alternately urging said shaft back and forth when said motor is turned on wherein said primary wall of said bellows is configured to repeatedly strike the infant's back thereby facilitating the infant to be burped.

6. The assembly according to claim 4, further comprising a speed switch being slidably coupled to said first wall of said housing wherein said speed switch is configured to be manipulated, said speed switch being electrically coupled to said processor such that said speed switch actuates said motor between a minimum speed and a maximum speed.

7. The assembly according to claim 4, further comprising a pressure switch being slidably coupled to said first wall of said housing wherein said pressure switch is configured to be manipulated, said pressure switch being electrically coupled to said processor such that said pressure switch actuates said motor between a minimum intensity and a maximum intensity.

8. The assembly according to claim 4, further comprising a power supply being coupled to said housing, said power supply being electrically coupled to said processor.

9. The assembly according to claim 8, wherein said power supply comprises at least one battery being removably positioned within said housing.

10. The assembly according to claim 9, further comprising a charge port being coupled to said outer wall of said housing wherein said charge port is configured to be electrically coupled to a power source, said charge port being electrically coupled to said at least one battery such that said charge port selectively charges said at least one battery.

11. The assembly according to claim 9, further comprising a light emitter being coupled to said outer wall of said housing wherein said light emitter is configured to emit light outwardly therefrom, said light emitter being electrically coupled to said at least one battery, said light emitter being turned on when said at least one battery is fully charged.

12. The assembly according to claim 9, further comprising a speaker being coupled to said first wall of said housing wherein said speaker is configured to emit an audible sound, said speaker being electrically coupled to said at least one battery, said speaker being turned on when said at least one battery is fully charged.

13. An infant burping assembly being configured to burp an infant when the infant is done feeding, said assembly comprising:

a harness being configured to be worn on an infant, said harness comprising:

a first strap having a first end and a second end, said first strap being configured to extend over an associated one of the infant's shoulders, and a second strap having a first end and a second end, said second strap being configured to extend over an associated one of the infant's shoulders, said second strap intersecting said first strap at a central hub such that each of said first strap and said second strap forms an X-shape; and a plunger unit being coupled to said harness wherein said plunger unit is configured to abut the infant's back, said plunger unit being actuated to move between an extended position and a retracted position wherein said plunger unit is configured to repeatedly strike the infant's back thereby facilitating the infant to be burped, said plunger unit comprising:

a housing having a first wall, a second wall and an outer wall extending therebetween, said outer wall being continuous such that said housing has a puck shape, each of said first end and said second end of said first strap being coupled to said outer wall, each of said first end and said second end of said second strap being coupled to said outer wall, a bellows having a primary wall and an exterior wall being coupled to said second wall of said housing having said primary wall being spaced from said second wall, said exterior wall having a plurality of pleats, said pleats being spaced apart from each other and being distributed between said second wall of said housing and said primary wall, said bellows being selectively positioned between a collapsed position and an extended position with respect to said second wall, said primary wall being configured to abut the infant's back when said harness is worn, a processor being positioned within said housing, a motor being positioned within said housing, said motor being electrically coupled to said processor, a shaft being coupled between said motor and said primary wall of said bellows, said motor alternately urging said shaft back and forth when said motor is turned on wherein said primary wall of said bellows is configured to repeatedly strike the infant's back thereby facilitating the infant to be burped, a speed switch being slidably coupled to said first wall of said housing wherein said speed switch is configured to be manipulated, said speed switch being electrically coupled to said processor such that said speed switch actuates said motor between a minimum speed and a maximum speed, a pressure switch being slidably coupled to said first wall of said housing wherein said pressure switch is configured to be manipulated, said pressure switch being electrically coupled to said processor such that said pressure switch actuates said motor between a minimum intensity and a maximum intensity, and a power supply being coupled to said housing, said power supply being electrically coupled to said processor, said power supply comprising:

at least one battery being removably positioned within said housing, a charge port being coupled to said outer wall of said housing wherein said charge port is configured to be electrically coupled to a power source, said charge port being electrically coupled to said at least one battery such that said charge port selectively charges said at least one battery, a light emitter being coupled to said outer wall of said housing wherein said light emitter is configured to emit light outwardly therefrom, said light emitter being electrically coupled to said at least one battery, said light emitter being turned on when said at least one battery is fully charged, and a speaker being coupled to said first wall of said housing wherein said speaker is configured to emit an audible sound, said speaker being electrically coupled to said at least one battery, said speaker being turned on when said at least one battery is fully charged.

* * * * *